United States Patent [19]

Fabel

[11] Patent Number: 4,460,676

[45] Date of Patent: Jul. 17, 1984

[54] NON-IMPACT SINGLE AND MULTI-PLY PRINTING METHOD AND APPARATUS

[76] Inventor: Warren M. Fabel, Peters La., Pound Ridge, N.Y. 10576

[21] Appl. No.: 123,344

[22] Filed: Feb. 21, 1980

[51] Int. Cl.[3] ..... G03C 5/24

[52] U.S. Cl. ..... 430/333; 430/346; 430/964; 430/338; 430/332; 430/339; 430/495; 430/348; 428/913; 281/2; 282/11.5 R; 355/18; 427/148

[58] Field of Search ..... 430/339, 338, 332, 348, 430/333, 495, 964; 427/148; 346/135.1; 229/69; 428/913; 250/316.1, 317.1; 354/5, 104, 100; 355/4, 1, 18; 281/2; 282/11.5 R

[56] References Cited

U.S. PATENT DOCUMENTS

| | | | |
|---|---|---|---|
| 1,391,310 | 9/1921 | Friese-Greene | 430/333 |
| 1,522,286 | 9/1925 | Fish | 430/538 |
| 2,625,494 | 1/1953 | Morrison | 428/913 |
| 2,999,035 | 9/1961 | Sahler | 430/495 |
| 3,157,526 | 11/1964 | Johnson et al. | 430/964 |
| 3,316,119 | 4/1967 | Anderson et al. | 430/964 |
| 3,592,650 | 7/1971 | De Selms | 430/338 |
| 3,792,481 | 2/1974 | Nagashima et al. | 250/316.1 |
| 4,172,605 | 10/1979 | Welsch et al. | 282/27.5 |

*Primary Examiner*—Won H. Louie, Jr.
*Attorney, Agent, or Firm*—Lilling & Greenspan

[57] ABSTRACT

Method and apparatus are described for non-impact printing of single and multi-ply business form assemblies, utilizing an electromagnetic radiation reactant chemical mixture which is selectively coated in one or more plies of the assemblies causing the plies to form images when selectively heated by the action of a controlled source by passing the radiation, such as microwave energy, through the business form assemblies.

6 Claims, 9 Drawing Figures

NON-IMPACT SINGLE AND MULTI-PLY PRINTING METHOD AND APPARATUS

BACKGROUND OF THE INVENTION

In the past, multi-ply forms have always been printed on impact type printers, utilizing either carbon or impact-reactable chemicals to produce copies on subsequent plies beyond the first.

All impact printers, character or matrix, utilize a mechanical process to strike the paper. The mechanical reciprocating parts, because they are subject to inertia, are also limited as to speed. Wear factors are very high; the combination of inertial forces and impact cause the machine to require more service and adjustment and cause more breakdowns than in other related computer components, which are totally electronic.

In addition to the aforementioned problems with impact printers, such printers have normally made use of chains, drums, keys, ribbon guides, etc. which frequently cause a form to catch, tear or jam.

The image produced by the impact printer tends to spread as the striking force is transferred through the various plies of paper and carbon tissue. The impact of the printing device is also absorbed by the paper itself, causing the image on each successive ply to be lighter and therefore more difficult to read. This, in addition to the spreading mentioned above, and the inherent plugging of characters caused by spreading, tends to limit the number of good plies that can be produced by an impact printer.

Over the years, the forms industry has attempted to improve the multi-ply image through the use of various carbon formulas, thinner carbon tissue and paper stock, calendering to render the paper smoother, and the use of carbon chemical papers which eliminate the bulk of the carbon tissue.

An additional drawback of the currently used carbonized or carbonless multi-part forms is that the business form assembly remains "live" if the carbon coatings or relative position of the carbonless papers remains intact, as exemplified by the pre-inserted mailer. The interior plies of the mailer are subject, after printing, to excessive smudging and bruising as it is processed through forms handling equipment and the postal service.

Carbonless papers are also prone to bruising and smudging when they are placed in files with the mated coatings in abutment. The adjacent coatings continue to react chemically due to the pressure on the file exerted by adjacent files in a tight space.

Another drawback of carbon as a means of image transfer is that the carbon coating uses a heavy grease or wax as a base or vehicle and therefore never dries. It is always susceptible to accidental smudging and also has a tendency to soil the hands and clothing of the user.

Self mailers have never been efficient for use when optical scanning of the turn-around document is required because of the inherent smudging and poor reproduction qualities of the one-time carbon used for image transfer. OCR scanners have been produced that are more tolerant of smudges and dirt and therefore require less contrast, but even these still exhibit too high a rejection rate for commercial acceptance when used with a mailer document.

An attempt has been made to produce an acceptable product by printing one line of OCR coding directly on the scannable document through a narrow die-cut window in the face of the outgoing envelope. The problem with this approach is that the open window area is unprotected and becomes dirty or smudged when going through the mail service. Also, the start read marks, on which the scanner registers with, are usually preprinted. If the insert shifts within the mailer envelope the start read mark does not register with the computer generated type. Since this is beyond the normal scope of the scanner's tolerance, the document could not be optically read and is rejected.

There has been a general trend in department stores and other credit-oriented organizations, to go "on line" rather than use batch processing of credit card transactions. The pressure type imprinters associated with embossed credit cards are no longer needed. Presently an input/output (CRT) computer terminal is used and the credit card number and other information is typed directly into this terminal. This eliminates the need for embossing on cards, the production of which has been a slow and costly procedure. To speed up production of these cards and eliminate the chance of a mismatch with the envelope, a plastic card pre-inserted in a mailer is used. The problem with this product is the smudging of the carbon image on the card. This same carbon image is easily altered. A thief can effortlessly wipe the card clean and fraudulently re-encode it. Even if the card is not subject to fraudulent use the carbon image will eventually wear away through normal use.

Additionally, carbon dope currently used in the business forms industry is a petroleum derived product which has become increasingly expensive to use and has also been, from time to time, in short supply and it can be expected that it will become scarcer and more expensive in the future because of the world's dwindling supplies of petroleum. One-time carbon is very inefficient in that less than a miniscule percentage of the total coating is used before the sheet is discarded. The need for tissue also creates a strain on our natural resources, mainly wood pulp. The carbon base also eliminates the possibility of recycling and is not bio-degradable.

Non-impact printers are also known. There are five major technologies in use today for non-impact printers. These are thermal, electrographic, electrostatic, photoelectrostatic and ink jet. While most non-impact printers are quiet, mechanically reliable, simple, fast and can print graphics as well as alphanumeric characters, the major drawback is that they produce only one copy at a time. Accordingly, existing non-impact printers cannot be used in connection with multi-ply business forms, such as pre-inserted mailers.

SUMMARY OF THE INVENTION

Accordingly, it is an object of the present invention to provide a non-impact single and multi-ply printing method and apparatus which do not have the disadvantages of the prior art methods and apparatus described in the previous section.

It is another object of the present invention to provide a non-impact printing method and apparatus which are suitable for imaging single and multi-ply business form assemblies.

It is still another object of the present invention to provide a non-impact printing method and apparatus which are efficient to operate and which minimize dependence on mechanical moving parts.

It is yet another object of the present invention to provide a non-impact printing method and apparatus which are electronic based so that the speed of printing is substantially enhanced.

It is a further object of the present invention to provide a non-impact printing method and apparatus which produce multiple copies of approximately equal quality when printing commonly used multiple-ply business form assemblies.

It is still a further object of the present invention to provide a non-impact printing method and apparatus which is only "live" during the imaging process, and, therefore, which cannot be smudged or bruised during subsequent forms handling equipment and processing by the postal service.

It is yet a further object of the present invention to provide a non-impact printing method and apparatus which provide characters of sufficient quality on multi-part forms to be readily read in OCR scanners and other automatic character recognition apparatus.

It is an additional object of the present invention to provide a non-impact printing method and apparatus which are suitable for use in remote printing applications such as at or substantially proximate to the desired destination of a business form or mailer, and, accordingly, can be used for such applications as electronic mail.

It is still an additional object of the present invention to provide a non-impact printing method and apparatus which are suitable for use in connection with pre-inserted mailers, contest blanks, credit cards or other applications where one or more layers or sheets must be imaged in a selective fashion.

It is a further additional object of the present invention to provide a non-impact printing method and apparatus which can effect multiple economies by eliminating, for example, the cover or top sheets commonly used during impact printing of mailers, eliminating carbon paper and the like.

In order to achieve the above objects, as well as others which will become apparent hereafter, the present invention is for a non-impact single and multi-ply printing method and apparatus which contemplate the use of an electromagnetic-radiation responsive color changing imaging material which fully or partially coated a substrate which is to be imaged. In the broader aspects of the present invention, any radiation responsive material may be used. In a presently preferred embodiment, the material is a heat sensitive color changing imaging material which becomes heated upon exposure to microwave radiation. The non-impact printer apparatus includes an imaging station and feeding means for advancing business form assemblies or the like through the imaging station. Means are provided for selectively exposing the treated portions of the plies disposed within said imaging station to electromagnetic radiation to form the desired imaging by selectively activating the electromagnetic-radiation responsive color changing material. By selectively coating a plurality of stacked plies with said imaging material, desired information can be imaged on only some of the plies and not on the others.

BRIEF DESCRIPTION OF THE DRAWINGS

The foregoing and other objects and features and advantages of the present invention will become clearer from the following detailed description of some illustrative embodiments of the present invention in conjunction with the accompanying drawings, in which.

DETAILED DESCRIPTION

Figure 1:
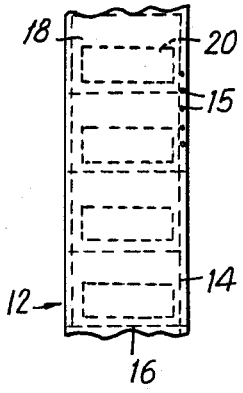
FIG. 1 is a fragmented top plan view of a series or web of business form assemblies in accordance with the present invention, and showing patches or lands of color changing imaging material which image when exposed to suitable radiation.
Figure 1A:
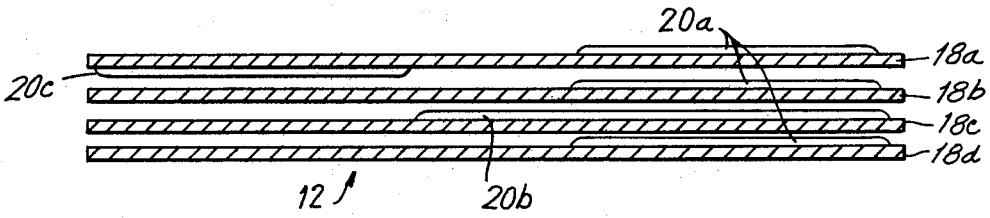
FIG. 1A is an enlarged cross-sectional view of the web shown in FIG. 1, taken along line 1A—1A, and showing, exaggerated, the way in which the plies or substrate layers of the business form assembly can be selectively coated on the front and the back with the color changing imaging material.

Referring now to the drawings, wherein the identical or similar parts have been designated by the same reference numerals throughout, and first referring to FIGS. 1 and 1A, a web 10 of series-connected business form assemblies 12 is shown. As will become evident from the description that follows, the specific business form assemblies used is not critical for purposes of the present invention, and may consist of a single ply or sheet or a plurality of such plies or sheets.

While the specific nature of the business form is not critical, it is preferable that the business form 12 be provided with marginal perforations 14 and standard control punching or sprocket hole 15 in the resulting margins to permit rapid and controlled movements of the business form assemblies through the non-impact printer in accordance with the present invention. Once the business form assembly 12 has been imaged, it can be separated from the web 10 along transverse or separation perforations 16 in accordance with well known techniques.

In accordance with an important feature of the present invention, at least one of the plies, sheets or substrates 18 has associated therewith an electromagnetic-radiation responsive color changing imaging material 20. For purposes of the discussion that follows, the aforementioned material will merely be referred to as "imaging material". However, it will be understood that such material responds to electromagnetic-radiation and, when exposed to such radiation, changes colors.

Referring to FIG. 1A, the plies or substrates 18*a*–18*d* are shown to be provided with imaging material in the nature of coatings on one or the other of the faces of the respective plies or substrates. Thus, small lands 20*a* of imaging material are coated on the face or top surfaces of the substrates 18*a*, 18*b* and 18*d*. A larger land 20*b* is provided on the face surface of the substrate 18*c*, while a back or rear coating or land 20*c* is provided on the rear surface of the substrate 18*a*.

Although the imaging material is shown to be in the nature of coatings in FIG. 1A, it is also possible that the imaging material be impregnated and dispersed throughout the substrate, that it be sprayed on the substrate or printed on the substrate. In most cases, it is desirable that the imaging material be selectively applied or incorporated in the substrates to permit selective imaging when multiple plies are stacked as suggested in FIG. 1A.

The imaging material may be any one of numerous chemical mixtures which respond to electromagnetic-radiation. Thus, there are known a plurality of imaging materials which change colors when heated. Such materials are described, for example, in U.S. Pat. Nos: 2,625,494; 2,663,657; 2,999,035; and 3,157,526. In order to make these materials responsive to electromagnetic radiation, such as microwaves, the materials disclosed in the aforementioned patents can be mixed or combined with any material which has the capability of absorbing radiation energy thereby producing a rise in temperature. Such substances are referred to as strongly absorbing or lossy substances, and include materials such as water, alcohols, ketones, amides, etc. Also, certain ferrites, usually catons of iron, lead, strontium or tin are also absorbent or lossy. On the other hand, such substances as paper, ceramic and glass are virtually transparent to microwaves. Therefore, the lossy materials absorb the microwave radiation, and it is the resulting rise in temperature that produces a change of colors of the composite mixture.

The advantage of using ferrites as the heat absorbing material is that many ferrites have the quality of absorbing microwaves until they reach a predetermined temperature, known as the "curie" point. At this temperature, they change properties and become transparent to the microwaves. At such time, they no longer absorb energy and, therefore, do not experience any further increases or rises in temperature. The ferrite curie point is different for each compound and is easily altered within a range of approximately 75°–660° C., well within the range of the imaging chemicals. In accordance with the presently preferred embodiments, the imaging materials include ferrites. These allow much faster heat rise times by using higher energy levels from the microwave sources without charring the plies or substrates or reaching the kindling point thereof. A discussion of ferrite materials which experience changes in microwave absorption when they reach a certain temperature is given in "Microwave Heating", Second Edition, by David A. Copson, the Avi Publishing Company, Inc., Westport, Conn., 1975.

The term "substrate" which has been used to refer to the plies of the business form is used in this application to mean the carrier of the imaging material in whatever form that may be. Thus, the substrate may be paper, plastic or any other material which may be coated or printed. However, the substrate should be a poor conductor of heat since otherwise it might conduct heat away from the imaging material and frustrate the imaging process.

While paper is normally transparent to microwave energy, it has been shown that normal moisture content in paper is sufficient to allow imaging by microwave heating. Such heating is not, however, at the desired speeds, and certainly much lower than by using more lossy and, therefore absorbent materials.

The coatings of the imaging material as contemplated by the present invention are staple up to 150° F. and only activated when exposed to microwave energy. This avoids smudging that would occur in later handling. By being activatable only at higher temperatures, the coatings are not "live" at normal ambient temperatures. This assures very concise high-contract imaging of the quality required for OCR reading.

While the presently preferred embodiment utilizes microwaves for activation of the imaging material, it will become evident that other forms of electromagnetic radiation can be used. Irrespective of the specific form of radiation used, it is only important that the imaging material be provided with a component which absorbs the type of radiation to which it is exposed. In this way, once the radiation is absorbed, the imaging material will experience a rise in temperature and a permanent chemical reaction will result. In addition to microwaves, infrared radiation can similarly be used. When processing single ply sheets, optical energy can likewise be used. However, a limitation in the use of optical radiation is that it does not penetrate the top sheet and, therefore, the optical approach is limited to single ply business forms. On the other hand, microwaves penetrate multiple plies and are, therefore, suitable for multiple-ply business form assemblies.

Figure 1C:
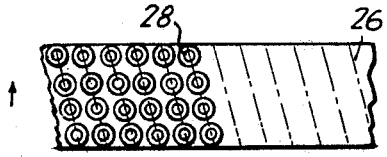
FIG. 1C, a typical bottom plan view section of the writing head 26 is shown, illustrating one possible arrangement of the radiators 28.
Figure 1B:
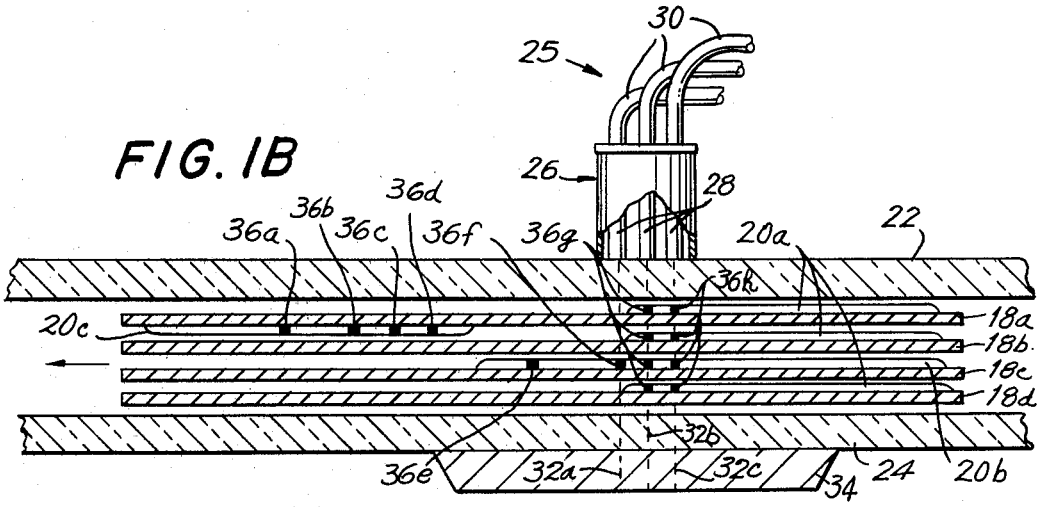
FIG. 1B is similar to FIG. 1A, additionally showing the web passing through an imaging station where the radiation sensitive imaging material coatings are exposed to radiation and thereby imaged electronically.

Referring to FIG. 1B, the method of non-impact printing in accordance with the present invention is illustrated. The individual plies or substrates 18*a*–18*d* are shown being advanced between smooth guide surfaces 22 and 24 to a printing station 25. The guide surfaces 22, 24 may be, for example, glass panels or made of any other material which is transparent to microwaves and, therefore, do not absorb the same. Provided on one side of the business form "packet" is a writing head 26 which includes means for selectively directing microwaves through the business form assembly plies or substrates, the writing head 26 including a plurality of radiators 28. The radiators 28 can be the open ends of an array of coaxial cables or guides 30 through which microwave energy is selectively transmitted.

The vertical dashed lines 32*a*, 32*b* and 32*c* are only exemplary of rays or beams of radiation which are emitted from the radiators 28 and which pass through the substrates or plies 18*a*–18*d*. As the rays or beams pass through the substrates and the coatings provided thereon, the rays provide localized heating of the imaging material layers and the rise in temperature cause the colors of the imaging materials to change to produce image portions 36*a*–36*h*. As the business form assembly advances between the guides 22 and 24, the rays or beams emanating from the radiators 28 are constantly changing in accordance with a preset program to produce the desired images on the various plies as shown in FIG. 1B. In some instances, the microwave rays or beams only penetrate one imaging material layer or coating to produce only singular images, as exemplified by image portions 36*a*–36*f*. On the other hand, where imaging material layers or coatings are stacked or superimposed, the same ray or beam can produce multiple images, as exemplified by image portions 36*g* and 36*h*.

Electromagnetic radiation has the property that it is reflected unless it is absorbed in a suitable load. Since undesired reflections of the microwave energy emanating from the writing head 26 may produce spurious images being formed on the substrates, there is advantageously provided a radiation absorbent material 34 opposite the writing head which absorbs the rays or beams of radiation 32*a*–32*c* to ensure that these are not reflected back towards the writing head. The radiation absorbent material 34 also minimizes the levels of microwave energy in the region of the writing head 26, thereby minimizing hazards to personnel.

The printing heat 26 shown in FIG. 1B is only intended to illustrate the general principle. The number of radiators 28 and their specific arrangement is not critical for purposes of the present invention, and any number of radiators and their arrangement may be used to suite a particular purpose. Thus, in FIG. 1C, a typical bottom plan view section of the writing head 26 is shown, illustrating one possible arrangement of the radiators 28. Here, the radiators are shown lined up in columns of four, the columns being slightly inclined with respect to the direction of relative movement between the printing head 26 and the business form assemblies which are being imaged. Such an arrangement can, for example, be used to decrease the space between the imaged dots or portions of a matrix and, therefore, increase the overall resolution of the finished product.

Additionally, it is noted that the business form assembly as well as the printing station are shown in somewhat exaggerated form in FIG. 1B. In this figure, the rays or beams of radiation 32*a*–32*c* are shown as idealized lines. Because electromagnetic radiation has a tendency to spread as it propagates, it will be clear to those skilled in the art that the distances between the writing head 26 and the furthest ply or substrate from the writing head which is to be imaged must be maintained relatively small. However, this model is accurate and resolution can be maintained at satisfactory levels with business forms of the type currently used which include up to approximately 5–8 plies.

Figure 2:
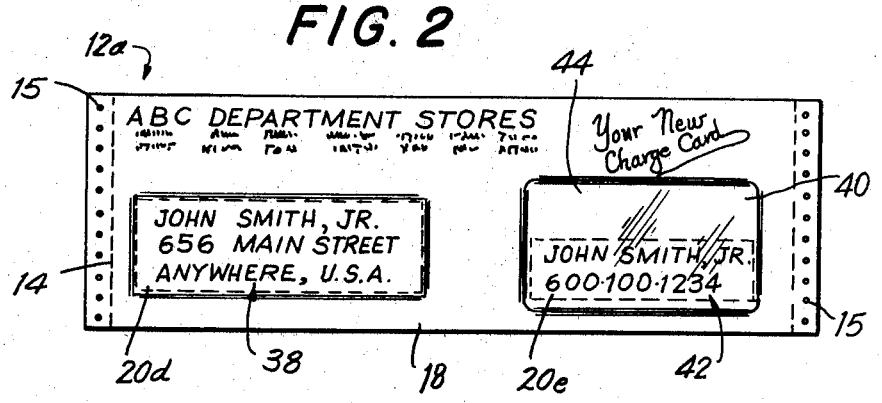
FIG. 2 is a top plan view of a business form assembly in the nature of a plastic credit charge card carrier, illustrating how the method and apparatus of the present invention can be utilized to image both the paper carrier as well as the plastic charge plate or card.
Figure 2A:
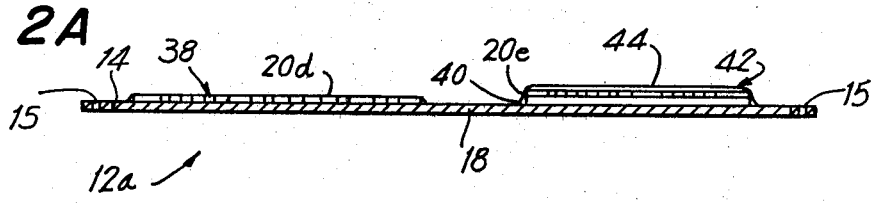
FIG. 2A is a front elevational view of the business form assembly shown in FIG. 2.

Referring to FIGS. 2 and 2A, there is illustrated a prime application of the method of the present invention. The business form assembly 12*a* includes the ply or substrate 18 on which there is directly provided a coating 20*d* of the imaging material which can be imaged to provide information 38 when advanced through a printing station 25 such as shown in FIG. 1B. Additionally, there is provided on the substrate 18 a paper or plastic card 40 which is in turn selectively provided with a coating 20*e* which, when passed through a printing station, and exposed to electromagnetic radiation in the form of microwaves, images to produce information or indicia 42.

The paper or plastic card 40, as well as the imaging material 20*e* can be covered with a clear or semi-clear coating 44, which renders the card tamper proof, completely dry and smudge proof. Since the clear or transparent coating 44 does not absorb microwaves, it is effectively invisible during the imaging process, the microwaves only being absorbed in the lossy or absorbent components present in the imaging material.

Figure 3:
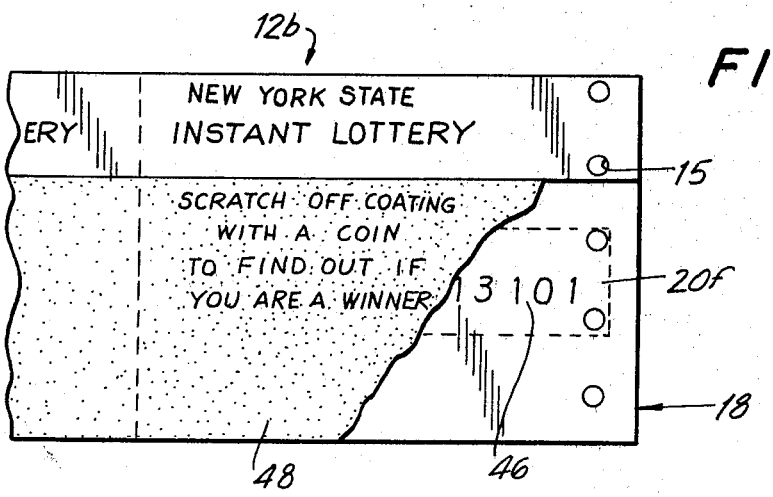
FIG. 3 is a fragmented top plan view of still another business form assembly in the nature of a contest blank, illustrating how the method and apparatus of the present invention can be used to image indicia or information beneath a removable opaque coating.

In FIG. 3, there is shown a further application of the non-impact printing method of the present invention. Here, the business form assembly 12*b* is the nature of a contest blank substrate 18 of the type commonly used for lotteries. The blanks can be produced as a plurality of units 4–8 wide in a continuous format for efficiency. The blank or substrate 18 is coated with imaging material 20*f* which, when exposed to microwave radiation and thereby becomes heated causes a chemical reaction and a change in color to image and provide indicia or information 46. The imaging material 20*f* is covered by a removable, opaque coating 48 so that the information or indicia 46 is not normally visible. The numbering of the blanks is accomplished by imaging in accordance with the present invention and this may be achieved prior to or subsequent to covering with the coating 48. However, by coating the blanks after the opaque coating has been applied renders the information invisible to the operator of the printer.

Figure 4:
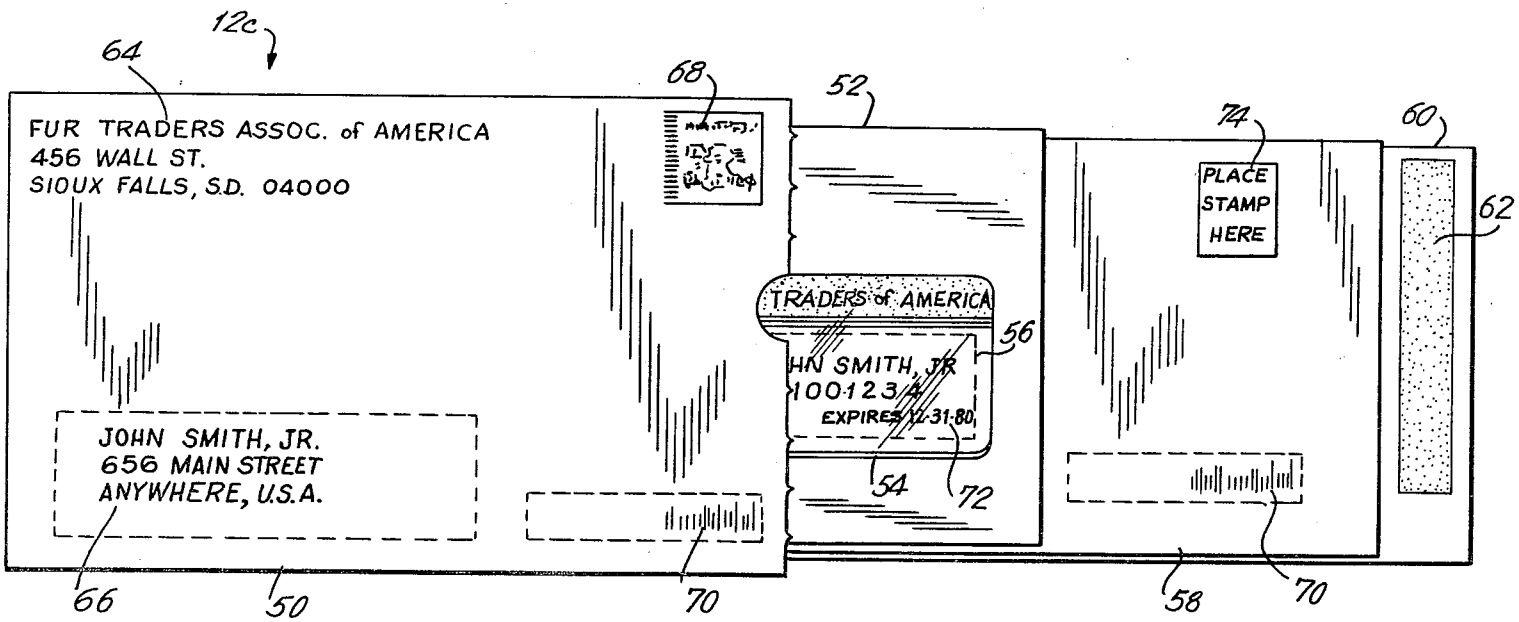
FIG. 4 is still another example of a business form assembly in the nature of a pre-inserted mailer, showing the versatility of the subject method and apparatus, and illustrating the manner in which the top ply or sheet of the business form assembly, as well as the internal plies or sheets, can be selectively imaged to provide various desired information.

In FIG. 4, there is shown a business form assembly in the nature of a pre-inserted mailer 12*c*, shown opened and partially disassembled. The mailer includes an outer or outgoing envelope 50, a correspondence piece 52, which may be in the nature of a letter or communication, invoice or card carrier which carries a plastic membership or charge card 54. Where a card 54 is mailed in this fashion, the is advantageously covered with a transparent sheet or coating 56 so as to render the card tamper-proof. The mailer 12C also includes an inner or return envelope 58 which is shown to include an end flap 60 provided with glue or adhesive 62 useful for sealing the return envelope 58 for, normally, returning it to the sender.

By selectively coating the various plies, sheets or substrates of the mailer 12C, the versatility or flexibility of the inventive method should be apparent. Thus, the outgoing envelope 50 may be selectively coated to allow imaging of return address indicia 64, addressee indicia 66, prepaid or bulk mail indicia 68 and bar code indicia 70. The information which may be imaged can, of course, be in either alpha or alpha-numeric characters. The bar code indicia 70 is intended to provide more efficient reading by optical scanners in the postal service. The card 54, by being selectively coated with imaging material and subsequently imaged, can itself be imparted with information or indicia 72. The same applies for the return envelope 58, which can likewise be imprinted with bar code indicia 70 and return postage information indicia 74. As suggested in FIG. 1B, duplication of the same information or indicia is possible by simply superimposing the coatings of imaging material, so that identical multiple indicia may be simultaneously printed. However, where information is only to appear on one of the sheets of substrates, a coating is provided on the respective layer or substrate which does not overlap any other land of imaging material along the path of penetration of the microwave energy.

Figure 5:
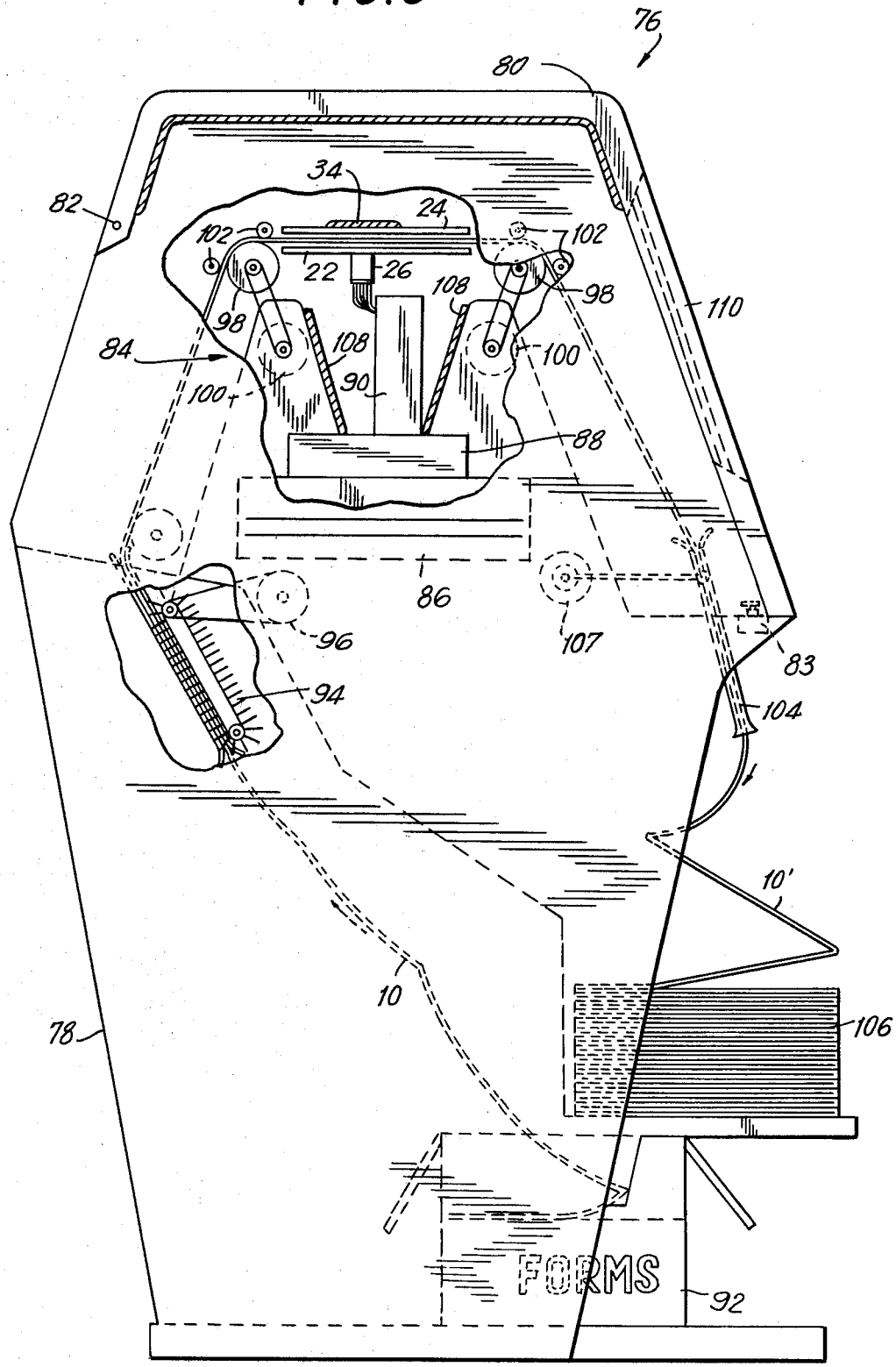
FIG. 5 is a fragmented, side elevational view of a non-impact printer in accordance with the present invention.

In FIG. 5, there is illustrated one embodiment of a non-impact printer which can be used to carry out the method of the present invention. The printer is designated by the reference numeral 76 and includes a housing 78 and a cover 80 which is movable about hinge pin 82 between the closed position shown in FIG. 5 and an open position which provides access to the printing station to be described. In the closed position of the cover 80, a safety switch 83 is actuated which enables the printing process. When the cover is open, the safety switch 83 disables the printing apparatus and prevents microwave energy from emanating from the printer and causing harm to personnel.

Provided within the housing 78 is the imaging or printing station 84 which includes a microwave source of energy 86. As mentioned previously, the present invention contemplates all types of electromagnetic radiation as long as the type used can be efficiently absorbed by the imaging material to cause the rise in temperature required to activate the imaging material to change colors. In the presently preferred embodiment, being described, however, the source of electromagnetic radiation 86 is a source of microwave energy and may include a magnetron or any other conventional means for producing microwaves.

The imaging station also includes a control section 88 which electronically regulates the sequences in which the microwave energy is to be fed to the coaxial cables or guides 30 inside the writing head 26. The control section 88 can be a general purpose computer or a dedicated mini- or microcomputer which is suitably programmed to produce the desired images or characters on the substrates advancing past the printing station. Through special programming, the computer can produce special type fonts (handwriting, etc.) for use in personalized direct mail. By slight alterations to the chemical coating, the image can print out the various colors as well as multi-color print-outs. Further, programming can allow the characters and lines to be rotated 90° for either vertical or horizontal printing. This will facilitate faster print speeds and/or a greater variety of form sizes and features.

To selectively channel the microwave energy from the source 88 to the various radiators 28 within the writing head 26, there is provided a switching network 90 which selectively opens or blocks the path to any particular coaxial cable 30 in accordance with a preprogrammed function. For example, the switching network 90 can comprise PIN diodes which are commonly used for control devices and switches. The PIN diodes can be used in the transmission lines and may be used in the microwave frequency range. Because PIN diodes do not rectify, they are ideal for use in high frequency switching since they do not introduce unwanted harmonics. Therefore, PIN diodes can be used for switching the microwave energy going into the coaxial cables 30. Such switching can be at very high speeds and does not exhibit the limitations inherent in mechanical switches and relays.

In accordance with one possible construction of the non-impact printer 76, therefore, the microwave source 86 produces microwave energy which is coupled into waveguide. The energy is subsequently electronically switched from the waveguide to one or more of the small diameter coaxial cables or guides 30. Of course, the smaller the diameter of the coaxial cables 30 and the radiators 28, the greater the resolution of the resulting image. While coaxial cables having outer diameters of approximately thirty thousandths of an inch are available, there are no theoretical limitations which prevent the coaxial cables from being made smaller, and these can be made to have outer diameters of approximately 5 mils. or even less.

Starting from the form infeed, the web 10 of business form assemblies feed up from the carton 92 to a pinfeed tractor 94 which is driven by a precision miniature motor 96. The web travels between driven friction rollers 98 which are rotated by miniature motors 100 and friction rollers 102. The motors 96 and 100 are also controlled by the control section 88 so that the imaging and the advancement of the web is carried out in synchronism. The business form assemblies exit the printer as shown where refolding is assisted by a driven chute 104, the form refolding neatly into a pack 106. The driven chute 104 is activated by a miniature motor 107 which is likewise controlled by the control section 88.

When the business form assemblies pass through the imaging station 84, they are selectively imaged by the heat produced by microwave absorption, stray microwaves being absorbed by the lossy or absorbent layers 34 and 108.

The cover 80 is advantageously provided with a transparent window 110 which permits the operator to observe the advancement of the imaged forms.

The non-impact printer of the present invention has the flexibility of an ink jet or xerographic printer, but with multi-copy capability of an impact printer. The system when used in conjunction with a pre-inserted mailer allows for the printing of both the face and the backs of the inserts, in OCR quality, at the same time allowing for the printing of special, highly readable OCR zipcode bar codes on the face both of the outgoing and/or return envelopes as described above. Variable return addresses are also possible when used with a two-way pre-inserted mailer.

When imprinting credit or membership cards as described with reference to FIG. 2, the sensitive imaging material coating may be sandwiched between opaque and clear vinyl layers which compose the finished card. In this way, the image could neither wear nor could it be altered, resulting in a fraud proof card. The production turn-around time would be exceptionally fast, when compared with currently used embossed plastic cards. The number of plies which can be imaged in accordance with the method of the present invention is only limited by the number of plies that the microwave beams can penetrate, and the capabilities of the feed mechanism. However, by using levels of microwave energy which are readily achievable with existing apparatus, most of the business form assemblies commonly used can be processed in accordance with the present invention.

The method and apparatus of the present invention has numerous advantages, many of which are self-evident from the above discussion. Thus, all copies in a multi-ply form are of essential equal print quality, as opposed to the carbon interleaved set wherein each successive ply gets progressively poorer. Additionally, the coatings of imaging material are totally dry. Smudging is eliminated and all plies are substantially equal in quality and permanence. Additionally, by suitable programming, the number of characters, fonts, logos, etc. that can be generated is unlimited. Since the switching network 90 can be controlled by both local as well as remote control sections, the invention is especially suitable for electronic mail and other remote printing applications.

By selecting the composition or ingredients of the imaging compound, including the color changing and the radiation absorbing ingredients, the resulting imaging compound can be composed to change colors at a predetermined threshhold temperature. When the imaging material is exposed to suitable radiation at the required levels, the threshhold temperature is obtained in local heating and the imaging compound is caused to change colors from the essentially invisible to the full imaged dark color, without generation of intermediate or gray colors.

While the principles of the present invention have been described in terms of several specific examples or embodiments, clearly the applications of the method and apparatus of the present invention are not so limited, and a person skilled in the art may modify or change the applications from the teachings of the principles of the present invention without departing from the spirit and scope thereof.

What is claimed is:

1. A method of simultaneous non-impact printing of individual plies of a multi-ply business form assembly, wherein the individual plies are substantially opaque and have portions thereof provided or treated with non-optical electromagnetic-radiation responsive, color changing imaging material, the method including the steps of advancing said business form assembly to a printing station; and selectively exposing said treated portions of said plies to non-optical electromagnetic radiation supplied by an arrangement consisting of a plurality of radiators for selectively directing said non-optical electromagnetic radiation, whereby multiple images are simultaneously non-impact printed on said treated portions of said plies.

2. A method as defined in claim 1, wherein said non-optical electromagnetic-radiation responsive, color changing imaging material changes colors when heated, and said step of selectively exposing to non-optical electromagnetic radiation comprises the step of selectively heating said imaging material.

3. A method as defined in claim 2, wherein said selective heating is carried out by successively locally heating said treated portions in a matrix pattern to create the desired alphanumeric characters or graphics.

4. A method as defined in claim 3, wherein said heating is controlled by a microprocessor.

5. A method as defined in claim 2, wherein said heating is carried out by directing a controlled beam of radiation at said portions treated with said heat sensitive color changing imaging material.

6. A method as defined in claim 5, wherein said beam of radiation is a beam of microwave electromagnetic radiation, and further comprising the step of scanning the beam in accordance with a pre-programmed sequence.

* * * * *